United States Patent [19]

Breslow

[11] 4,061,335

[45] Dec. 6, 1977

[54] BOARD GAME APPARATUS

[75] Inventor: Jeffrey D. Breslow, Highland Park, Ill.

[73] Assignee: Marvin Glass & Associates, Chicago, Ill.

[21] Appl. No.: 653,934

[22] Filed: Jan. 30, 1976

[51] Int. Cl.[2] ..... A62F 3/00

[52] U.S. Cl. ..... 273/134 AT; 273/134 E; 273/138 R; 273/131; 273/134 R; 273/131 AB; 273/134 AE; 273/131 AD; 273/134 AG

[58] Field of Search ..... 273/134, 138

[56] References Cited

U.S. PATENT DOCUMENTS

| | | | |
|---|---|---|---|
| 3,367,662 | 2/1968 | Charles et al. | 273/134 AD |
| 3,599,979 | 8/1971 | Weisbecker | 273/138 R |
| 3,741,546 | 6/1973 | Chen | 273/134 AD |

*Primary Examiner*—Delbert B. Lowe
*Attorney, Agent, or Firm*—Mason, Kolehmainen, Rathburn & Wyss

[57] ABSTRACT

The present invention provides a game apparatus in the form of a chance device for use by a plurality of players in combination with a game board. The game board includes a central area and a playing area peripheral thereto with the playing area being defined by a path along which playing pieces are advanced by players of the game. In the preferred form, the playing path is an endless path defined by a series of playing stations. The central area of the board provides a support surface for the chance device. The chance device constitutes a receiver or depository device, preferably in the form of a wishing well or like structure, for receiving value or barter items, such as play coins, deposited therein through an opening. The depository device is partitioned to include a plurality of hidden compartments for receiving the value items at random from the opening. Each of the compartments has a movable wall portion for gaining access to the interior thereof for retrieving items as a reward during play of the game, as determined by a player's move or other rules of the game.

6 Claims, 5 Drawing Figures

Fig 1
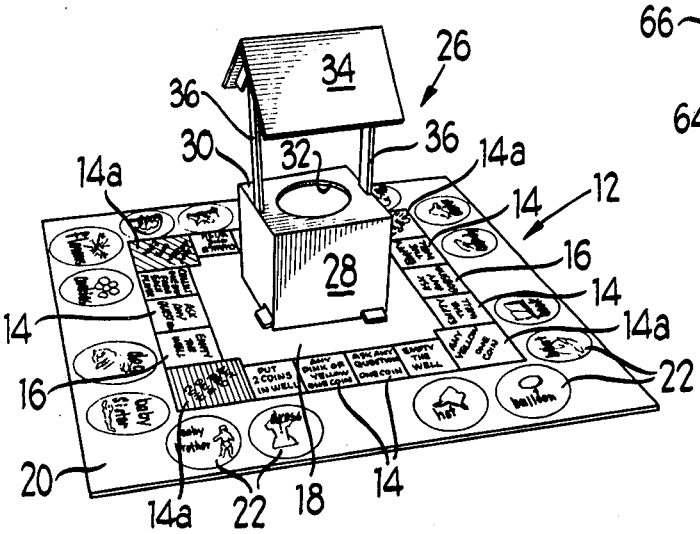
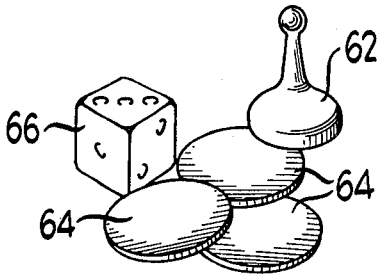
Fig 5
Fig 4
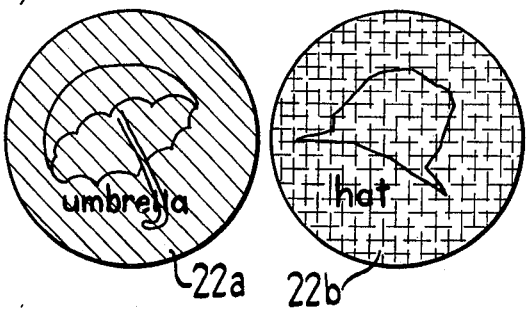
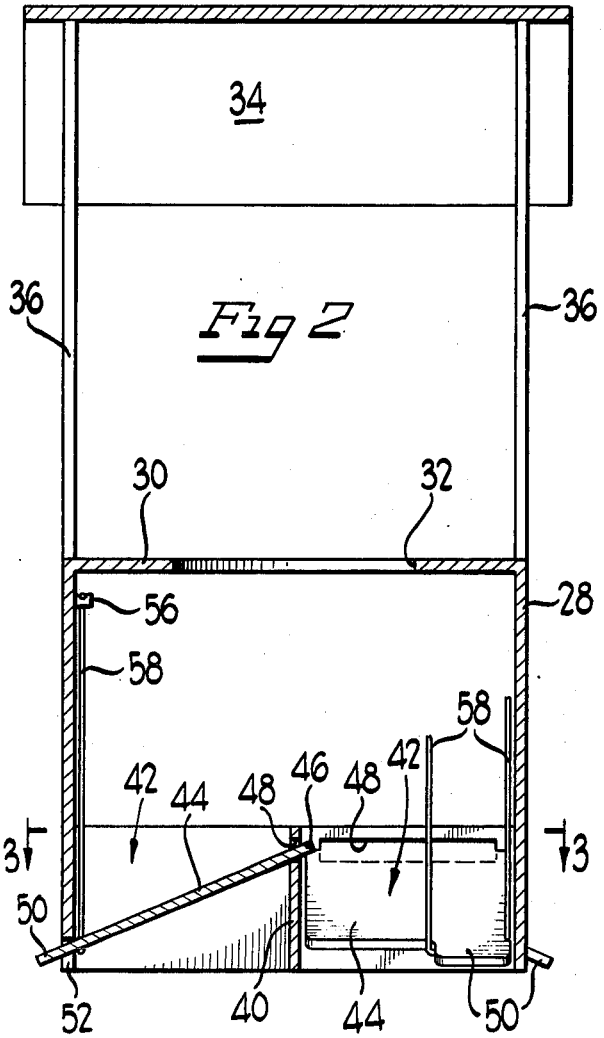
Fig 2
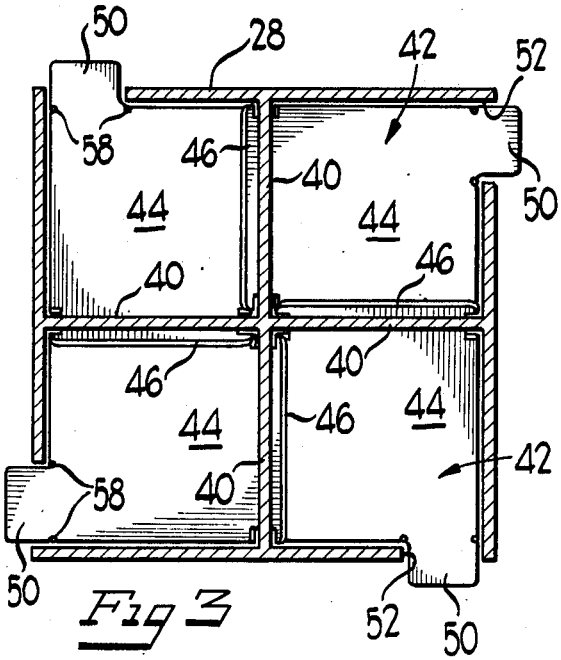
Fig 3

BOARD GAME APPARATUS

BACKGROUND OF THE INVENTION

1. Field of the Invention

The present invention relates generally to games of chance and in particular to a chance device for use in rewarding players during play of such games. Additionally, the invention relates to a combination of the chance device with a game board upon which players' play pieces are moved from station to station during play of the game to partially determine the reward to be received from the chance device.

2. Description of the Prior Art

In the past, board games have enjoyed a great deal of popularity. In the normal board game, players are provided with playing pieces, one for each player, and the board includes a playing path having a plurality of aligned playing stations along which the pieces are advanced in accordance with the dictates of a spinner or a die. As a playing piece is advanced along the path, the player is required or permitted to act in accordance with indicia at the particular station on which his playing piece lands, or in accordance with other rules of the game.

SUMMARY OF THE INVENTION

An apparatus for playing a game of chance using a chance device for dispensing rewards in accordance with the play of a player. The chance device is in the form of a miniature simulated wishing well. The wishing well includes a base casing having a top opening and a hood or roof supported above the top opening. Within the base portion of the wishing well, partition walls are provided dividing the base portion into a plurality of compartments, each of which is accessible for receiving, on a random basis, barter or value items such as coins deposited through the top opening. Each compartment has a pivotally mounted trap door type bottom wall portion normally biased to a closed position closing the bottom of the compartment but having a manually grippable tab extending from the side of the bottom wall portion for pivoting the bottom wall to an open position for retrieval of items from the compartment. The structure of the pivotal mounting of each bottom wall includes a tongue extending as a portion of the bottom wall through a slot in a partition wall and the biasing to normally closed position is accomplished by a grounded rubberband or other tension means.

The chance device is normally used in combination with a game board which has a central portion on which the chance device rests, surrounded by a playing path in the form of a closed circuit or loop of playing stations.

In the play of the game using the chance device in combination with the game board, a number of indicia-bearing cards are dealt to each player. Each card has more than one identifiable feature printed thereon. Each player, in his turn, rolls a die or spins a spinner to determine his move. Depending on his move and in accordance with instructions at the station where he lands, the player may deposit one or more coins into the wishing well for the purpose of purchasing a question to be asked of one of the other players regarding the identity of part of the indicia on the dealt cards of that other player. If the player guesses the identity correctly, upon depositing another coin the player may ask a further and more specific question and this process continues until the player identifies the other player's card completely. Upon complete identification of another player's card, the successful player is rewarded by being permitted to select a compartment of the wishing well base and release any coins therein. Each time a player's card indicia is guessed, it becomes an exposed card and the winner of the game is the player with the last unexposed card.

The squares or rectangles composing the play path include indicating means directing, dictating and/or limiting what the player may do during his turn, e.g., the number of coins to be deposited in the wishing well, limitations on the questions to be asked, and the like.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

DESCRIPTION OF THE DRAWINGS

FIG. 1 is a perspective view of an embodiment of the game apparatus of this invention, showing a chance device in the form of a toy wishing well;

FIG. 2 is a vertical sectional view, on an enlarged scale, through the wishing well shown in the embodiment of FIG. 1;

FIG. 3 is a sectional view taken generally along line 3—3 of FIG. 2;

FIG. 4 is a plan view of playing cards for use in playing a game with the game apparatus of FIG. 1; and FIG. 5 is a perspective view of other accessories for play of the game illustrated in FIG. 1.

DETAILED DESCRIPTION OF THE PREFERRED EMBODIMENT

Referring first to FIG. 1, the illustrated game apparatus includes a game board, generally indicated by reference numeral 12, and having a succession of playing stations in the form of rectangular stations 14 and square corner stations **14*a* defined by suitable borders and, in turn, defining an endless circuitors path. The stations 14*a* at the corners of the path in the form illustrated in FIG. 1 define player starting stations. Each starting station 14*a* includes distinguishing means such as a different color for player designation purposes and to designate each corner of the board as a separate playing area. Within the borders of the stations 14 or 14*a* are printed play-directing indicia, as at 16**, which direct, determine or suggest a player's next action.

Also provided on the game board 12 is a central area 18 bounded by the playing path. Surrounding the playing path is a marginal area outside of the playing path on which is imprinted a plurality of distinctive small playing areas 22, four within each large, corner playing area. The playing areas 22 each include identifying means identical to that on a set of playing cards described below.

Removably supported within central area 18 is a chance device in the form of a free standing receiver or depository means, shown as a wishing well 26, having a base 28 (FIGS. 1 through 3) with a top wall 30 and an opening 32 through top wall 30. A hood in the form of a roof 34 is supported from base 28 by support posts 36.

Turning now more particularly to FIGS. 2 and 3, the lower part of the base 28 is divided by interior partition means in the form of separator walls 40 into four separate hidden compartments 42. Each compartment 42 has a movable bottom wall portion for the purpose of retrieving items from the respective compartment. In the embodiment shown, the movable wall portion is in the form of a bottom wall 44 having a tongue 46 received in a slot 48 in a separator wall 40 to form a fulcrum for pivoting the bottom wall 44 downward in a trap door fashion to open the compartment. For this purpose, a manually grippable means is provided for each bottom wall 44 in the form of an externally exposed tab 50 which, with the bottom wall 44 in closed position, is received in a tab receiving slot 52.

Each bottom wall 44 normally is retained in closed position by appropriate biasing means. Accordingly, a lug 56 is provided spaced above each tab 50 on the inside of the base casing 28 for grounding a tension means in the form of a rubberband 58 which is looped over lug 56 at one end and over tab 50 at the other end to normally draw the bottom wall 44 pivotally toward closed position.

Accessories are provided for play of a game using the illustrated embodiment of the invention. Referring to FIG. 5, each player is provided with a playing piece 62, different in color from each other player's playing piece and identical in color to one of the corner stations **14*a* which is that player's starting station. Players also are provided with a supply of value items in the form of simulated coins 64. The players alternate turns of play and the advance of a player from his starting station and around the path of play stations 14 throughout the game are controlled by a roll of a die 66** during the player's turn.

The game, as illustrated, is in the form of a mystery game in which wish cards have combinations of first distinguishing means such as colors identical to the previously discussed colors on the corners **14*a*, and second distinguishing means identical to the distinguishing means on the small playing areas, identifying a specific card, different from each other card, and defining a composite mystery to be guessed by other players in the game. For example, in FIG. 4, a card 22*a* has printed thereon the image of an umbrella having a distinctive color background (the first distinguishing means), e.g., green. A card 22*b* has printed thereon the outline of a hat and also has a distinctive color background, e.g., yellow. The cards are pictorially identical to the indicating means 22 on the board 12**. A supply of the cards, e.g., three in number, is dealt to each of the players from a pack of such cards, face down and hiding the identity of the mystery.

Briefly, the objective of the game is for players to "solve" the mystery of another player's cards. The player with the last remaining unidentified mystery card is the winner.

Each player also is provided with a supply of coins 64 in a predetermined number, e.g., five, at the outset of the game for use during play of the game. As a player advances around the board 12 and his playing piece 62 lands on a particular station, he then must follow the instructions printed on the game board at that station. The instructions may direct him to deposit one or more coins 64 in the wishing well, collect coins from other players, or the like. Also appearing in the play path are play stations permitting the player to ask a question of another player regarding a mystery card of that other player in an attempt to identify the mystery on the card. The permission to ask a question may be unlimited as to the type of question or it may be limited in scope to the identity of a particular color or other characteristic printed on the playing card. For example, he may ask "Is the card pink?" should the player want to ask the question, he must pay by depositing a coin 64 in opening 32. If he receives an affirmative identification, he then may ask any player a question about any of the player's cards, again after paying by depositing a coin 64. The object of the questions about the player's mystery cards is to eventually expose the other player's cards as to their identity at which time they are turned face up in margin area 20. It may take a number of questions to expose a particular card, each question becoming more limited in sequence. Once a player's full supply of cards 22 has been exposed, that player is eliminated from the game.

If a player's initial supply of coins runs out, he can receive more coins by landing on a station instructing payment to him from the wishing well or from other players. In the meantime, he continues to take his turn but cannot ask questions until he can pay for them.

A player who completely exposes another player's mystery card is permitted to select one of the compartments of wishing well 26 and depress the bottom wall 44 thereof, using tab 50, and thereby release any coins which may have fallen randomly into the particular compartment. This, again, rewards the player with a supply of coins.

In the game as illustrated, at least one play station 14 contains permission for the player landing thereon to exchange one of his mystery cards for one still in the pack. It will be recognized that this additional feature is advantageous because a player may have an unexposed mystery card which has not yet been identified but, because of previous questioning, is in imminent danger of being exposed. This feature, by permitting the exchange of the previously questioned card, adds another element of chance to the game.

It will be apparent from the foregoing that the present invention provides a new and useful board game as well as a new and useful chance device. Modifications will be apparent to those having ordinary skill in the art.

I claim:

1. A board game apparatus for a plurality of players, comprising, in combination:

a playing board, a relatively large playing area about the periphery of the board, a course positioned interiorly of said large area defining a path of travel, said path of travel being divided into a plurality of stations, and including instruction stations having indicia thereon with reference to the playing rules which indicate a particular function to be performed by a player;

a plurality of sets of distinctive small playing areas within said relatively large playing area including means for distinguishing each said set of small playing areas from the remaining sets of small playing areas on the playing board, said distinguishing means comprising identifying stations on said path of travel, each of said identifying stations being associated with and adjacent one of said sets of small playing areas;

a first set of movable playing pieces for movement over said playing piece path of travel;

a second set of playing pieces having identical distinguishing means for defining a relationship to one set of small playing areas within a portion of said relatively large playing area, second identical means for indicating a relationship to one of the distinctive small playing areas within said related portion of said identified large playing area and means for concealing the same from the other players of the game;

a group of monetary tokens for payment of rewards to and penalties by players of the game; and means for determining how many stations a particular movable playing piece is to be moved by a player along said path of travel defined by said stations.

2. The board game apparatus of claim 1 wherein said second identical means is identical to the indicia on said distinctive small playing areas.

3. The board game apparatus of claim 2 wherein said second set of playing pieces comprises a deck of cards to be randomly distributed to the players of the game.

4. The board game apparatus of claim 3 wherein the distinguishing means correlating the distinctive small playing areas with the portions of the relatively large playing area includes a plurality of colors.

5. A board game apparatus, comprising, in combination:

a game board having a playing surface on one side thereof;

a course of travel defined on said playing board by a plurality of adjacent stations;

a first set of movable playing pieces, at least one for each player of the game, for movement over the course of travel indicative of players' position and movement, each playing piece having first distinguishing means;

a group of monetary tokens for payment of rewards to and penalties by players of the game;

means for determining how many stations a movable playing piece is to be moved by a player along said path of travel defined by said stations;

a plurality of wish cards to be randomly acquired by the players, each card having said first distinguishing means and a second distinguishing means for indicating a particular relationship between both the board, the playing pieces and the following elements;

a relatively large playing area on the playing surface side of the board circumscribing said course, said playing area being subdivided into a plurality of portions by distinguishing means which is identical to the first distinguishing means on said playing cards and said playing pieces; and a plurality of positions defined within each said identified portion of said large playing area, each position including distinguishing means identical to the second distinguishing means on said playing cards.

6. A board game apparatus, comprising, in combination:

a game board having a playing surface on one side thereof;

a course of travel defined on said playing board by a plurality of adjacent stations;

a first set of movable playing pieces, at least one for each player of the game, for movement over the course of travel indicative of players' position and movement, each playing piece having first distinguishing means;

a group of monetary tokens for payment of rewards to and penalties by players of the game;

depository means on the board for receiving a plurality of said monetary tokens from the players of the game;

means for determining how many stations a movable playing piece is to be moved by a player along said path of travel defined by said stations;

a plurality of wish cards to be acquired by the players according to the rules of the game, each card having said first distinguishing means and a second distinguishing means for indicating a particular relationship between both the board, the playing pieces and the following elements;

a relatively large playing area on the playing surface side of the board circumscribing said course, said playing area being subdivided into a plurality of portions by distinguishing means which is identical to the first distinguishing means on said playing cards and said playing pieces; and a plurality of positions defined within each said identified portion of said large playing area, each position including distinguishing means identical to the second distinguishing means on said playing cards.

* * * * *